US011120960B2

(12) United States Patent
Hoffmann

(10) Patent No.: US 11,120,960 B2
(45) Date of Patent: Sep. 14, 2021

(54) MODULAR CONTACTOR ARRANGEMENT

(71) Applicant: Phoenix Contact GmbH & Co. KG, Blomberg (DE)

(72) Inventor: Ralf Hoffmann, Berlin (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 257 days.

(21) Appl. No.: 16/472,774

(22) PCT Filed: Dec. 21, 2017

(86) PCT No.: PCT/EP2017/084250
§ 371 (c)(1),
(2) Date: Jun. 21, 2019

(87) PCT Pub. No.: WO2018/115374
PCT Pub. Date: Jun. 28, 2018

(65) Prior Publication Data

US 2021/0134550 A1 May 6, 2021

(30) Foreign Application Priority Data

Dec. 22, 2016 (DE) ..... 102016125382.0

(51) Int. Cl.
*H01H 67/02* (2006.01)
*H01H 50/04* (2006.01)
(Continued)

(52) U.S. Cl.
CPC ..... *H01H 50/047* (2013.01); *H01H 1/20* (2013.01); *H01H 11/0031* (2013.01);
(Continued)

(58) Field of Classification Search
CPC .. H01H 50/047; H01H 71/08; H01H 11/0031; H01H 1/20; H01H 47/004; H01R 9/26
(Continued)

(56) References Cited

U.S. PATENT DOCUMENTS 3,451,018 A * 6/1969 Di Marco ..... H01H 50/546 335/131
5,606,299 A * 2/1997 Innes ..... H01H 50/021 335/132
(Continued)

FOREIGN PATENT DOCUMENTS

CN 1200837 12/1998
CN 102365699 2/2012
(Continued)

OTHER PUBLICATIONS

Authorized Officer: Nora Lindner, English Translation of the International Preliminary Report on Patentability issued in corresponding PCT application No. PCT/EP2017/084250, dated Jul. 4, 2019, 9 pp.
(Continued)

*Primary Examiner* — Shawki S Ismail
*Assistant Examiner* — Lisa N Homza
(74) *Attorney, Agent, or Firm* — Kaplan Breyer Schwarz, LLP

(57) ABSTRACT

A modular switching contactor arrangement for use in a safety-oriented application, has two switching contactor modules that can be arranged in succession by means of a coupling module, the switching contactor modules and the coupling module merely having to be joined together by a user, without any external wiring, so as to be mechanically and electrically coupled to one another. In the mounted state, the switching contactor arrangement has a reduced construction width that is substantially delimited by the narrow faces of the switching contactor modules. In particular, the construction width can be 22.5 mm.

14 Claims, 8 Drawing Sheets

(51) Int. Cl.

| | |
|---|---|
| ***H01H 47/00*** | (2006.01) |
| ***H01H 71/08*** | (2006.01) |
| ***H01R 9/26*** | (2006.01) |
| ***H01H 11/00*** | (2006.01) |
| ***H01H 1/20*** | (2006.01) |

(52) U.S. Cl.
CPC ..... *H01H 47/004* (2013.01); *H01H 71/08* (2013.01); *H01R 9/26* (2013.01)

(58) Field of Classification Search
USPC ..... 355/132
See application file for complete search history.

(56) References Cited

U.S. PATENT DOCUMENTS

| | | | | |
|---|---|---|---|---|
| 5,870,278 | A | 2/1999 | Girard et al. | |
| 6,198,614 | B1 * | 3/2001 | Kappel | H01H 47/08 361/115 |
| 6,537,110 | B1 * | 3/2003 | Korsunsky | H01R 13/6658 439/38 |
| 6,540,564 | B1 * | 4/2003 | Ko | H01R 24/64 439/489 |
| 7,898,374 | B2 * | 3/2011 | Miller | H05K 7/1432 335/202 |
| 10,361,051 | B2 * | 7/2019 | Bock | H01H 9/563 |
| 2003/0087559 | A1 * | 5/2003 | Korsunsky | H01R 13/719 439/676 |
| 2008/0296843 | A1 * | 12/2008 | Hoffmann | H01H 49/00 277/314 |
| 2009/0102584 | A1 * | 4/2009 | Zende | H01H 71/0271 335/10 |
| 2014/0126158 | A1 * | 5/2014 | Baran | H01R 9/2458 361/729 |
| 2015/0048909 | A1 * | 2/2015 | Heinrich | H01H 50/041 335/85 |
| 2015/0131185 | A1 * | 5/2015 | Martin | H01H 71/00 361/31 |
| 2015/0135016 | A1 * | 5/2015 | Glaser | G06F 11/0709 714/37 |
| 2015/0325397 | A1 * | 11/2015 | Larcher | H01H 50/16 335/187 |
| 2018/0314024 | A1 * | 11/2018 | Ishimine | H01R 13/518 |
| 2019/0326086 | A1 * | 10/2019 | Hoffmann | H01H 1/26 |
| 2021/0075132 | A1 * | 3/2021 | Hoffmann | H01R 9/2433 |

FOREIGN PATENT DOCUMENTS

| | | | |
|---|---|---|---|
| CN | 102668007 | A | 9/2012 |
| DE | 8815851 | U1 | 2/1989 |
| DE | 4234619 | C2 | 5/1994 |
| DE | 19515923 | A1 | 11/1996 |
| DE | 29721521 | U1 | 2/1998 |
| DE | 29908612 | U1 | 7/1999 |
| DE | 10003349 | A1 | 8/2001 |
| DE | 10224976 | A1 | 1/2004 |
| DE | 10304492 | A1 | 8/2004 |
| DE | 69825349 | T2 | 1/2005 |
| DE | 102005061152 | A1 | 6/2007 |
| DE | 60033878 | T2 | 11/2007 |
| DE | 102008062250 | A1 | 6/2009 |
| DE | 102008031200 | A1 | 1/2010 |
| DE | 102008031335 | A1 | 1/2010 |
| DE | 102010025675 | B3 | 11/2011 |
| DE | 102012024352 | A1 | 7/2014 |
| EP | 0896351 | A2 | 2/1999 |
| JP | 63-187523 | A | 8/1988 |
| JP | 2003-511841 | A | 3/2003 |
| JP | 2009-123419 | A | 6/2009 |
| WO | 2006/094959 | A1 | 9/2006 |

OTHER PUBLICATIONS

Authorized Officer: Voye-Piccoli, Alexandra, International Search Report issued in PCT application No. PCT/EP2017/084250, dated Apr. 18, 2018, 12 pp.

Office Action issued in German application No. 102016125382.0, dated Sep. 26, 2017, 10 pp.

Office Action issued in counterpart Japanese patent application No. 2019-534337, dated May 13, 2020, 12 pp.

English translation of Office Action issued in counterpart Japanese Patent Application No. 2019-534337 dated Nov. 25, 2020.

English Translation of Office Action dated Sep. 2, 2020 in counterpart Chinese Patent Application No. 201780080053.0.

* cited by examiner

MODULAR CONTACTOR ARRANGEMENT

FIELD

The invention relates to a modularly assemblable switching contactor arrangement, which can be used in particular for use in a safety-oriented application, for example in an industrial automation system.

BACKGROUND

So as to be able to switch high charges in electrical systems, for example in industrial automation systems, two contactors comprising make contacts and break contacts, which are used for feeding back the switching state, are connected in series. The contactors are actuated by means of a safety switching device, which controls the contactors by way of output signals and can thus switch a charge via the contactors. A drawback of the known contactors is that the contactors formed as separate switching elements have to be wired to one another and to the safety switching device by the user himself. In addition, the lateral installation of the contactors on a safety switching device results in a relatively high space requirement, since the total width results from the sum of the individual widths of the contactors and of the safety switching device.

Usually, the safety switching device is accommodated in a housing having a standard width of 22.5 mm, while the two switches are each accommodated in a standard housing having a width of 45 mm. This results in a total width of 112.5 mm for a safety switching system.

SUMMARY

The object of the invention is to create a modular switching contactor arrangement which requires a small construction space and can be assembled without any electrical wiring that additionally has to be undertaken.

A central idea of the invention is that two switching contactor modules are arranged in succession by means of a coupling module, the switching contactor modules and the coupling module merely having to be joined together by a user, without any external wiring, so as to be mechanically and electrically coupled to one another. In this context, in the mounted state, the construction width of the switching contactor arrangement is substantially determined by the narrow faces of the switching contactor modules.

In accordance with a further consideration, the modular switching contactor arrangement may have a safety switching module, to which the two switching contactor modules and the coupling module can be electrically and mechanically coupled in a simple manner, in other words without additional manual wiring.

The aforementioned technical problem is solved by the features of claim 1. Advantageous developments form the subject matter of the dependent claims.

Accordingly, a modular, in other words modularly assemblable, switching contactor arrangement for use in a safety-oriented application is provided. The modular switching contactor arrangement has a first and a second switching contactor module, each switching contactor module having the following features:

a switching contactor arranged in a housing and first electrical terminals and second electrical terminals, one make contact of the switching contactor being arranged in each case between each first electrical terminal and each second electrical terminal, the housing having a rectangular base face of a first predetermined width, two side faces, which are arranged mutually parallel and at a distance from one another that corresponds to the first predetermined width of the housing, and a first terminal face and a second terminal face, which oppose one another, have a first predetermined width and are each arranged perpendicular to the base face at least in portions, the first electrical terminals being arranged on the first terminal face and the second electrical terminals being arranged on the second terminal face, a coupling module of a second predetermined width substantially equal to the first predetermined width, the coupling module having an electrical coupling device comprising first electrical terminals and second electrical terminals that are formed and arranged for electrical coupling to the first electrical terminals of the first and second switching contactor module respectively, the first switching contactor module and the second switching contactor module being electrically and mechanically couplable by means of the coupling module in such a way that, in the mounted state, the make contacts of the first switching contactor module and the make contacts of the second switching contactor module are electrically connected in series in each case and the construction width of the switching contactor arrangement is substantially equal to the first and second predetermined width respectively.

In an advantageous development, the coupling module has a housing of a width that substantially corresponds to the second predetermined width. The coupling device is arranged in the housing, the housing of the coupling module having two side faces, which are arranged mutually parallel and at a distance from one another that defines the second predetermined width of the housing, and a first terminal face and a second terminal face, which oppose one another, each have the second predetermined width and are arranged perpendicular to the two side faces. The first electrical terminals are arranged on the first terminal face and the second electrical terminals are arranged on the second terminal face.

An advantageous configuration provides that the first and second predetermined widths are each between 20 mm and 30 mm. A width of substantially 22.5 mm is found to be particularly advantageous.

It should be noted that the side faces of the housing form longitudinal faces and the first and second terminal faces of the housing form narrow faces.

To make a narrow construction possible, in the mounted state the first electrical terminals and the second electrical terminals of the first switching contactor module, of the second switching contactor module and of the coupling module are positioned in a shared plane that extends parallel or perpendicular to the base face of the housings of the switching contactor modules.

Expediently, the first electrical terminals and the second electrical terminals of the first switching contactor module, of the second switching contactor module and of the coupling module may in each case be arranged along a straight line that extends perpendicular or parallel between the two side faces of the switching contactor module housing in question.

So as to be placeable in a power safety switching device, the first switching contactor module and the second switching contactor module have three first electrical terminals each and three second electrical terminals each, the switching contactors of the first and second switching contactor modules each having three make contacts. The coupling module has three first electrical terminals and three second electrical terminals in this case. In this way, for example a three-phase motor can be connected to the modular switching contactor arrangement.

Reliable and secure coupling of the switching contactor modules to the coupling module can be achieved if the first and second switching contactor modules each have mechanical connecting elements for mechanical connection to mechanical connecting elements of the coupling module.

So as to be able to signal the switching state of the switching contactor modules, the switching contactors of the first switching contactor module and of the second switching contactor module each have a break contact and a magnet system comprising a coil. Further, the first switching contactor module and the second switching contactor module each have two third electrical terminals, connected to the break contact, for connecting a control and evaluation device, and each have two fourth electrical terminals, connected to the coil, for connecting a supply source. The third and fourth electrical terminals are arranged on a third terminal face, which opposes the base face of the housing in question.

A narrow construction of the switching contactor modules and of the coupling module can be achieved if the two third and fourth electrical terminals of the first and second switching contactor modules are in each case arranged along a straight line that extends perpendicular or parallel between the two side faces of the housing in question.

So as to be able to expand the switching contactor arrangement into a modular safety switching system, a control and evaluation device that can be connected to the third terminals of the first and second switching contactor modules is provided, and is formed to monitor and read back the switching states of the break contacts and to switch on and off a power supply source to the fourth terminals of the first and second switching contactor modules in a controlled manner.

A particularly compact construction is brought about if the control and evaluation device is arranged in the housing of the coupling module. In this case, the coupling module has a first set of third and fourth terminals and a second set of third and fourth terminals, which are arranged in such a way that, in the assembled state of the modular switching contactor arrangement, the terminals are electrically connected to the third and fourth terminals of the first switching contactor module and to the third and fourth terminals of the second switching second switching contactor module respectively.

Alternatively, a safety switching module may be provided which has a width that substantially corresponds to the second predetermined width, the control and evaluation device being arranged in the housing of the safety switching module. The housing of the safety switching module has a base face on which a first set of first and second electrical terminals and a second set of first and second electrical terminals are arranged in such a way that, in the assembled state, the first and second electrical terminals respectively of the safety switching module are electrically connected to the third and fourth terminals of the first switching contactor module and to the third and fourth terminals of the second switching contactor module respectively. The base face of the safety switching module has fixing means for mechanical coupling to the first switching contactor module and/or the second switching contactor module and/or to the coupling module.

An advantageous development provides that the coupling module has a measurement device that is assigned to the first and second terminals of the coupling module for measuring currents and/or voltages, the measurement device being electrically connected to the control and evaluation device.

So as to be able to mount the module switching contactor arrangement on a carrier rail, the housing of the first and/or second switching contactor module and/or the housing of the coupling module and/or the safety module may have fixing means for fixing to a carrier rail. In the latched-on state, the first and second terminal faces of the switching contactor modules extend parallel to the longitudinal axis of the carrier rails. In other words, the switching contactor modules that are arranged in succession by means of the coupling module have a longitudinal extent that extends perpendicular to the longitudinal axis of the carrier rail. Consequently, the width of the switching contactor arrangement in the latched-on state is determined by the width of the first and second terminal faces, which is preferably only 22.5 mm.

BRIEF DESCRIPTION OF THE DRAWINGS

Hereinafter, the invention is described in greater detail by way of two embodiments in connection with the accompanying drawings, in which.

DETAILED DESCRIPTION

Figure 1:
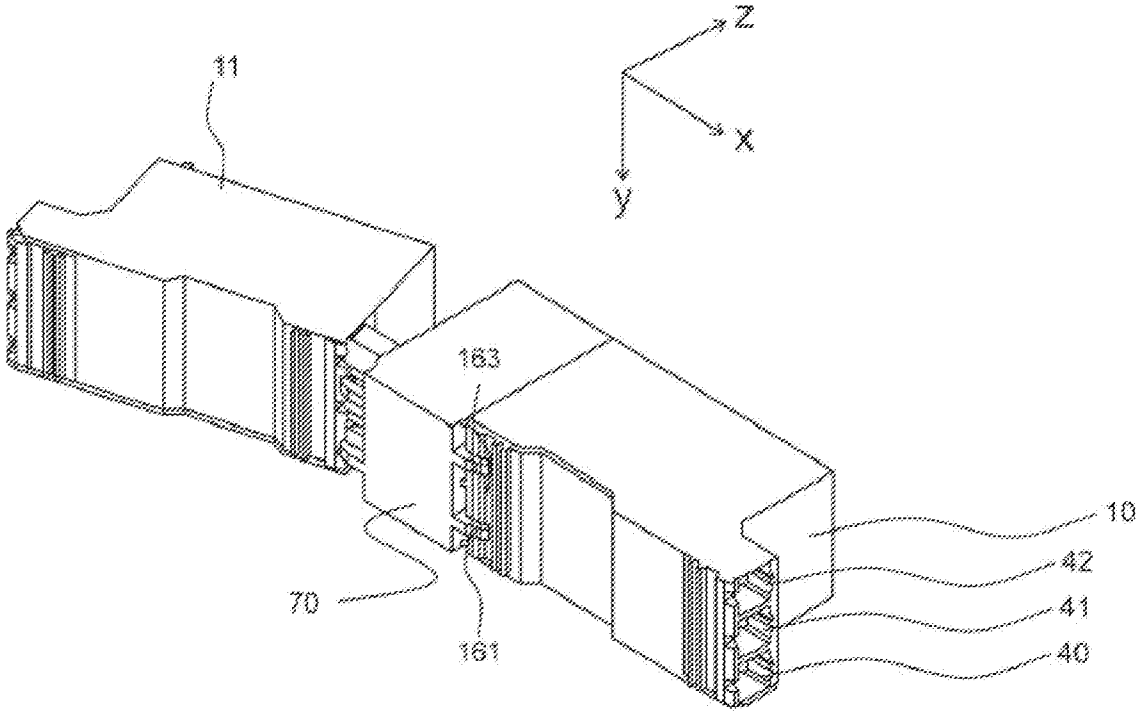
FIG. 1 is a perspective view of an example modular switching contactor arrangement comprising a coupling module, a switching contactor module connected to the coupling module, and a switching contactor module that is not yet connected to the coupling module.

FIG. 1 is a perspective view of an example modular switching contactor arrangement 180, which can be used in particular for use in a safety-oriented application, for example in an industrial automation system.

The modular switching contactor arrangement 180 has a first switching contactor module 10 and a second switching contactor module 11, which can be mechanically and electrically coupled to one another via a coupling module 70. As is shown in FIG. 1, the switching contactor module 10 is already mechanically and electrically connected to the coupling module 70, while the other switching contactor module 11 is not yet connected to the coupling module. At this point, it should be noted that the two switching contactor modules 10 and 11 may be constructed substantially identically. In the present example, it should be assumed that the two switching contactor modules 10 and 11 are constructed identically, and so the switching contactor modules are described in detail merely with reference to the switching contactor module 10.

Figure 3:
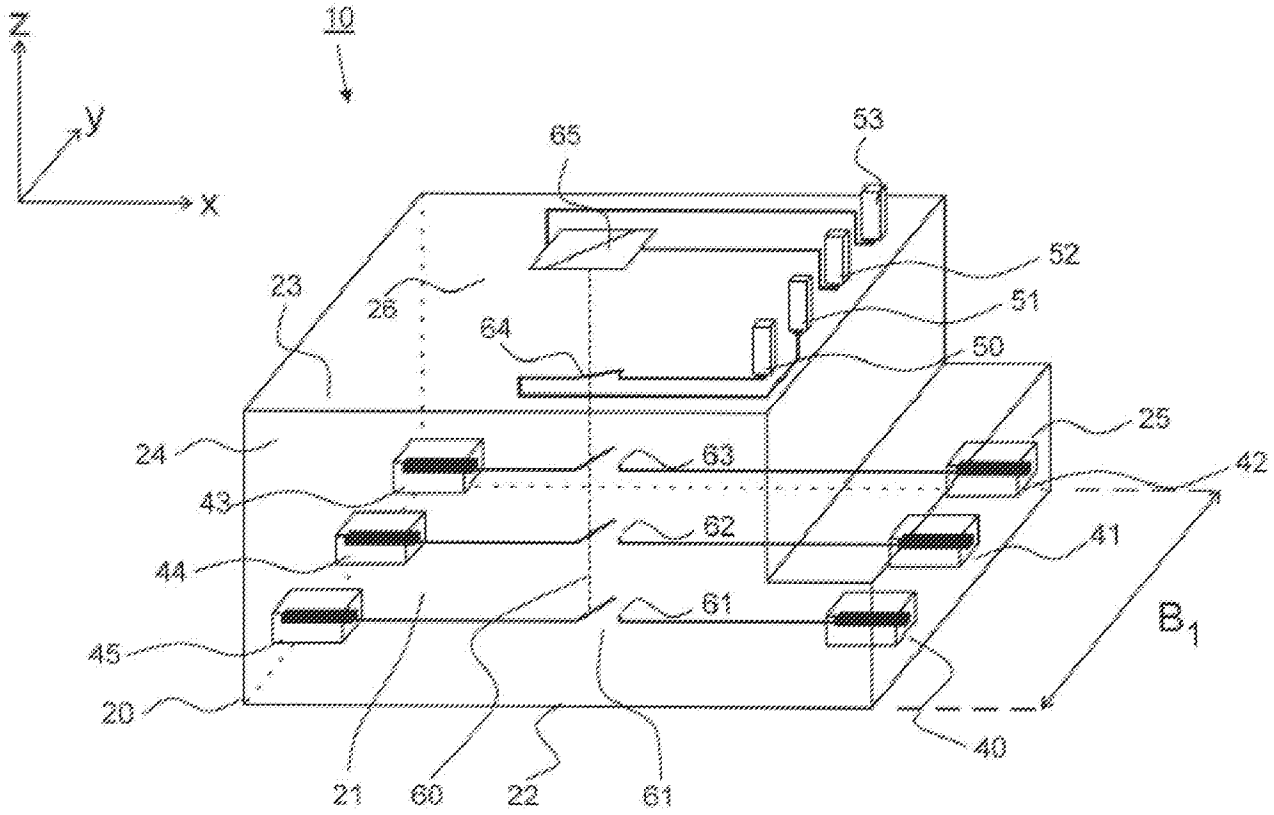
FIG. 3 is a schematic internal view of the switching contactor module shown in FIG. 1.

The internal construction of the switching contactor module 10, and thus also of the switching contactor module 11, can be seen most clearly in FIG. 3. The switching contactor module 10 has a housing 20, in which a switching contactor 60 is arranged. The switching contactor module 10 further has first electrical terminals and second electrical terminals, three first electrical terminals 43 to 45 and three electrical terminals 40 to 42 being present in the example shown. Between each first electrical terminal and each second electrical terminal, a make contact of the switching contactor 60 is arranged in each case. In the present example, three make contacts 61 to 63 are provided, and are arranged between the terminal pair 40, 45, the terminal pair 41, 44 and the terminal pair 42, 43 respectively.

Consequently, a three-phase load can be connected to the switching contactor arrangement.

The first and second electrical terminals are advantageously formed as contact pins, and are preferably positioned entirely within the housing 20. It is naturally also conceivable that the first and second terminals may be formed as contact sockets.

The housing 20 has a rectangular base face 21, which has a predetermined width B1. At this point, it should be noted that the width B1 may preferably be between 20 mm and 30 mm. It is particularly advantageous if the width B1 is substantially 22.5 mm.

The housing 20 has two side faces 22 and 26, which are arranged mutually parallel and at a distance from one another that corresponds to the first predetermined width B1 of the housing 20. The side faces 22 and 26 form the longitudinal faces of the housing 20. Further, a first terminal face 24 and a second terminal face 25 are provided, which oppose one another, have the first predetermined width B1 and are preferably each arranged perpendicular to the two side faces 22 and 26 and perpendicular to the base face 21 at least in portions. The terminal faces 24 and 25 form the narrow faces of the housing 20.

The housing 20 shown in FIG. 3 by way of example has a second terminal face 25 that extends substantially in an L shape. The first electrical terminals 43 to 45 are arranged on the first terminal face 24, while the second electrical terminals 40 to 42 are arranged on the second terminal face 25.

Figure 4:
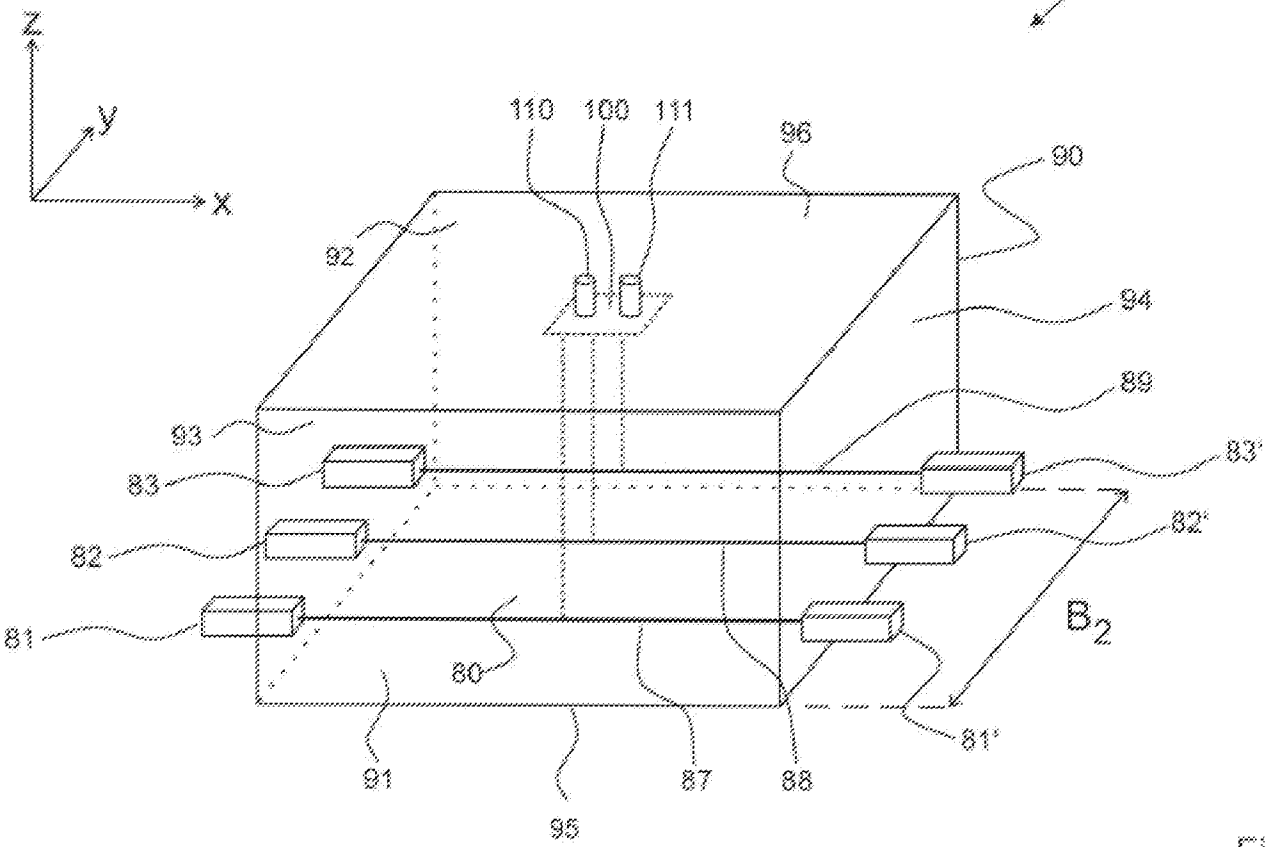
FIG. 4 is a perspective view of a coupling module, in which the internal construction is shown schematically.

An example construction of the coupling module 70 is shown in greater detail in FIG. 4. The coupling module 70 has a predetermined construction width B2, which is substantially equal to the first predetermined width B1 of the switching contactor module 10. Consequently, the construction width of the coupling module 70 is preferably 20 mm to 30 mm. A construction width of 22.5 mm is particularly advantageous. The coupling module 70 has a coupling device 80 comprising first electrical terminals and second electrical terminals. As a function of the number of terminals of the switching contactor module 10, in the present example the coupling module 70 has three first electrical terminals 81 to 83 and three second electrical terminals 81' to 83'. The first electrical terminals 81 to 83 and the second electrical terminals 81' to 83' are formed and arranged for electrically coupling to the first electrical terminals 43 to 45 of the first switching contactor module 10 and to the first electrical terminals of the second switching contactor module 11 respectively.

As can be seen in FIG. 4, the first and second electrical terminals of the coupling module 70 may be formed as contact sockets, which are for example positioned outside a housing 90 of the coupling module 70.

The first switching contactor module 10 and the second switching contactor module 11 are electrically and mechanically couplable by means of the coupling module 70 in such a way that, in the mounted state, the make contacts 61 to 63 of the first switching contactor module 10 and the make contacts of the second switching contactor module 11 are electrically connected in series in each case, as can be discerned from FIG. 1, when the switching contactor module 11 is also coupled to the coupling module 70.

Preferably, the coupling module 70 is accommodated in the housing 90, which has substantially the second predetermined construction width B2. The coupling device 80 is arranged at least in part within the housing 90. Between the terminals, which are preferably formed as contact sockets, an electrical connection extends in each case. Specifically, an electrical connection 87 extends between the terminals 81 and 81', an electrical connection 88 extends between the terminals 82 and 82', and a further electrical connection 89 extends between the terminals 83 and 83'. The electrical connections 87 to 89 may each be an electrically conductive wire.

The housing 90 of the coupling module 70 has two side faces 91 and 92, which are arranged mutually parallel at a predefined distance from one another that defines the second predetermined width B2 of the housing, and a first terminal face 93 and a second terminal face 94, which oppose one another, each have the second predetermined width B2 and are arranged perpendicular to the two side faces 91 and 92. The first electrical terminals 81 to 83 are preferably arranged on the first terminal face 93, while the second electrical terminals 81' to 83' are arranged on the second terminal face 94. As mentioned previously, terminals 81 to 83 and 81' to 83' may in part or in whole be passed out of the respective terminal faces 93 and 94.

As can be seen in FIG. 1, in the coupled state the modular switching contactor arrangement 180 has a longitudinal extent in the y-direction while the construction width pointing in the x-direction is defined by the width B1 or B2 of the associated narrow faces 24 and 25 of the housings 20 or by the terminal faces 91 and 92 of the housing 90.

To maintain such a narrow construction of the modular switching contactor arrangement 180, it may be provided that in the mounted state of the switching contactor arrangement 180 the first electrical terminals 43 to 45 of the first and second switching contactor modules, the first electrical terminals 81 to 83 of the coupling module, the second electrical terminals 40 to 42 of the first and second switching contactor modules and the second electrical terminals 81' to 83' of the coupling module are positioned in a shared plane that extends parallel or perpendicular to the base face of the housing 20 of the two switching contactor modules 10 and 11. In the embodiment shown in FIGS. 1 to 5*c*, the respective electrical terminals are positioned in a shared plane that extends parallel to the base face 21 of the housing 20 and, if present, parallel to a base face 95 of the housing 90. A perpendicular arrangement of the respective terminals can be seen in FIG. 6, which is described in greater detail hereinafter.

In other words, in the mounted state, the first electrical terminals 43 to 45 and the second electrical terminals 40 to 42 of the first and second switching contactor modules and the first electrical terminals 81 to 83 and the second electrical terminals 81' to 83' of the coupling module 70 are preferably in each case arranged along a straight line that extends perpendicular between the two side faces 22 and 26 of the associated switching contactor module housing 20 or perpendicular between the two side faces 91 and 92 of the housing 90.

As can be seen in FIGS. 3 and 4, the terminals 43 to 45, the terminals 40 to 42 and the make contacts 61-63 are preferably each arranged close to the base face 21, while the terminals 81 to 83, the terminals 81' to 83' and the connecting wires 87 to 89 of the coupling module are preferably arranged close to the base face 95 of the housing 90.

Figure 5A:
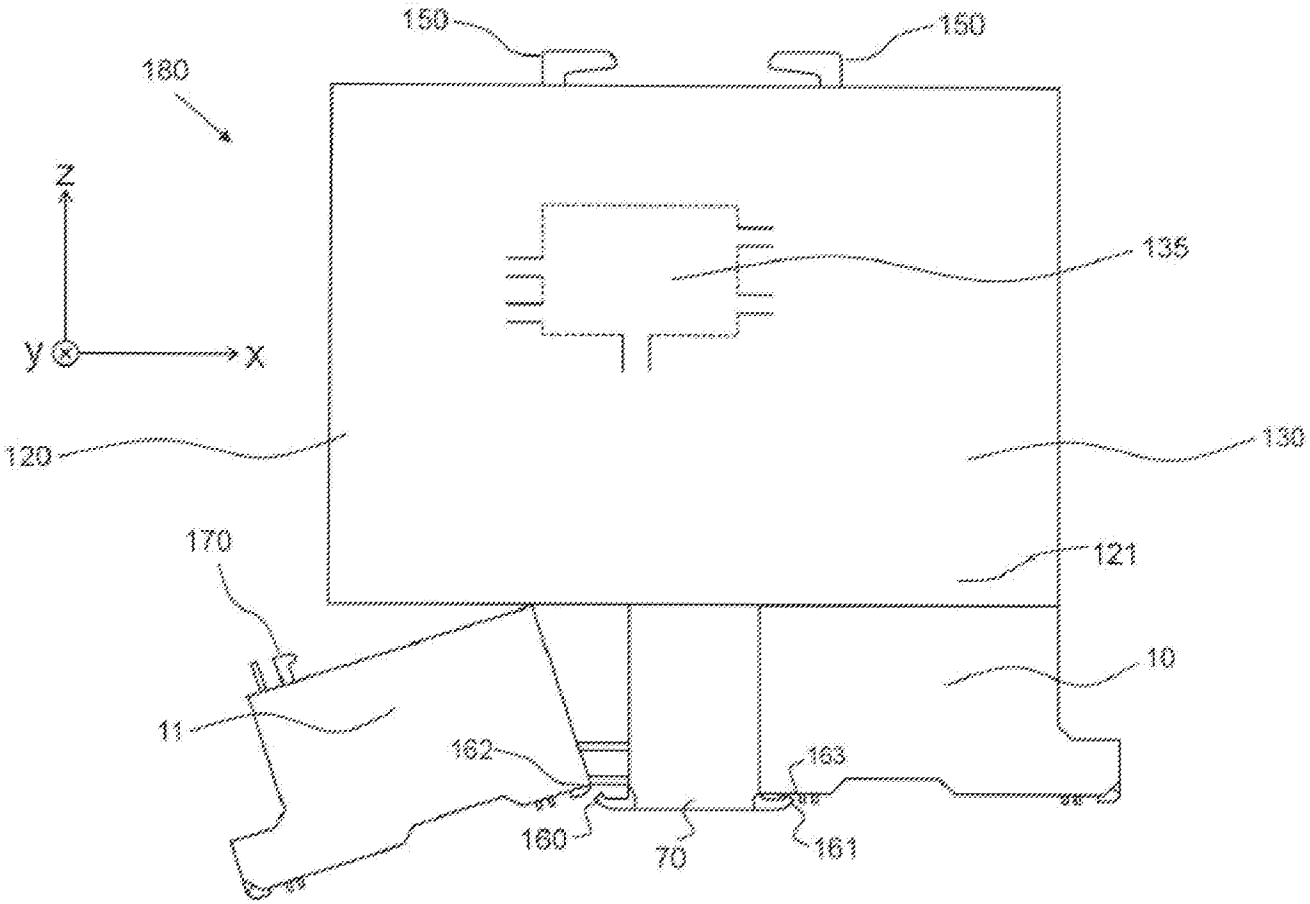
FIG. 5*a* is an example modular switching contactor arrangement for implementing a power safety switching system, comprising two switching contactor modules according to FIG. 2, a coupling module according to FIG. 4 and a safety switching module.
Figure 5B:
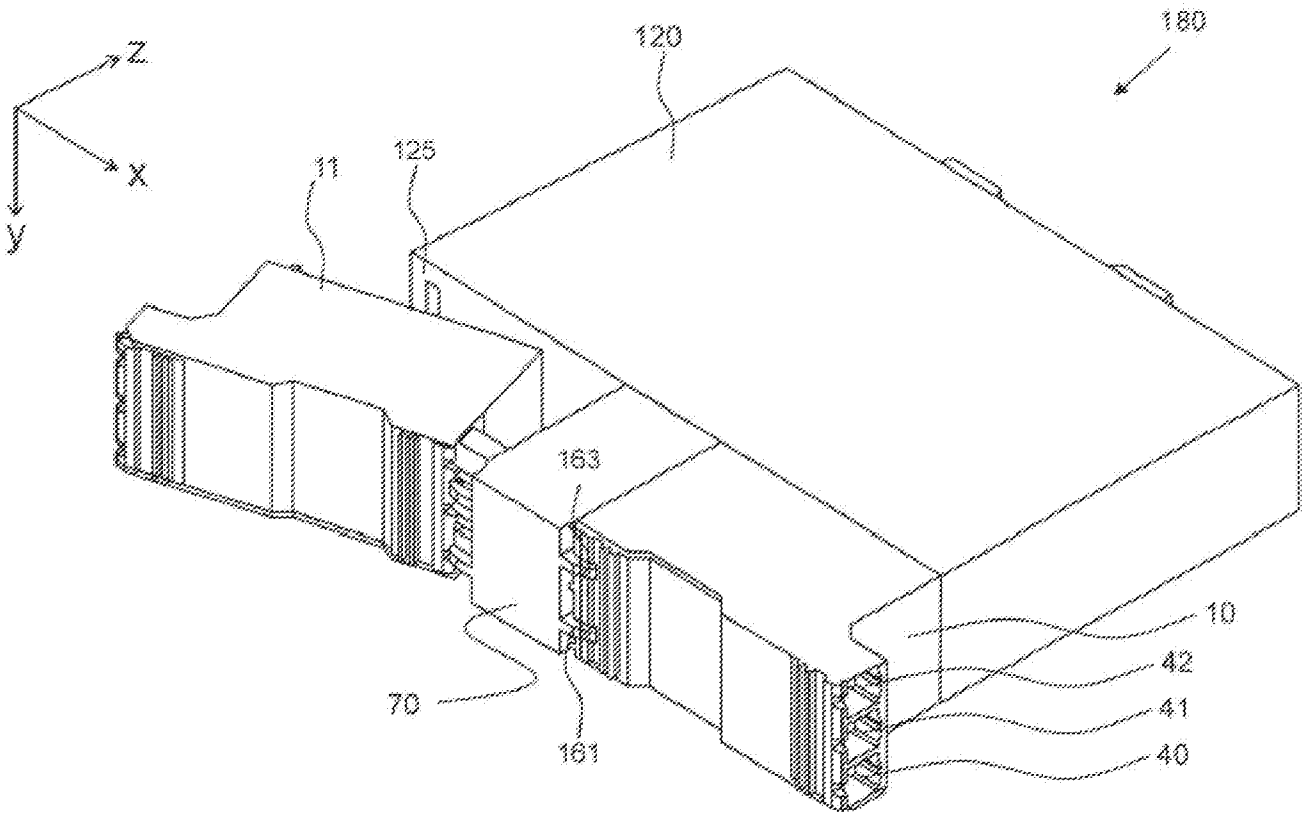
FIG. 5*b* is a perspective view of the modular switching contactor arrangement shown in FIG. 5*a*.

So as to be able to connect the two switching contactor modules 10 and 11 mechanically to the coupling module 70, the switching contactor modules 10 and 11 have corresponding mechanical connecting elements 162 and 163, which are couplable to corresponding complementary connecting elements 160 and 161 of the housing 90 of the coupling module 70. The corresponding mechanical connecting or coupling elements are shown in FIGS. 5*a* and 5*b*.

So as to be able to monitor the switching state of the switching contactor modules, as is shown in FIG. 3, the switching contactor 60 of the switching contactor module 10 and thus also the switching contactor module 11 may each have a break contact 64 and a magnet system comprising a coil 65. The break contact 64 and the coil 65 may be arranged above the make contacts 61 to 63 in the housing 20 as considered in the z-direction. The two switching contactor modules 10 and 11 may each have two third electrical terminals 50 and 51, connected to the break contact 64, for connecting a control and evaluation device and each have two fourth electrical terminals 52 and 53, connected to the coil 64, for connecting a supply source (not shown). The third and fourth terminals may be configured at least in part for example as contact pins on a third terminal face 23. The third contact face 23 opposes the base face 21 of the housing 20 and forms an upper face of the housing 20.

As can be seen in FIG. 3, the third and fourth terminals 50 to 53 of the switching contactor module 10 are preferably arranged along a straight line that extends parallel between the two side faces 22 and 26 of the housing 20 and thus parallel to the y-axis of the depicted coordinate system. As can further be seen in FIG. 3, the third terminal face 23 may be shorter than the base face 21 as considered in the x-direction. In the example shown, this is due to the fact that the terminal face 25 has a substantially L-shaped extension. Preferably, the third and fourth electrical terminals 50 to 53 are arranged close to an outer edge of the terminal face 23.

Figure 2:
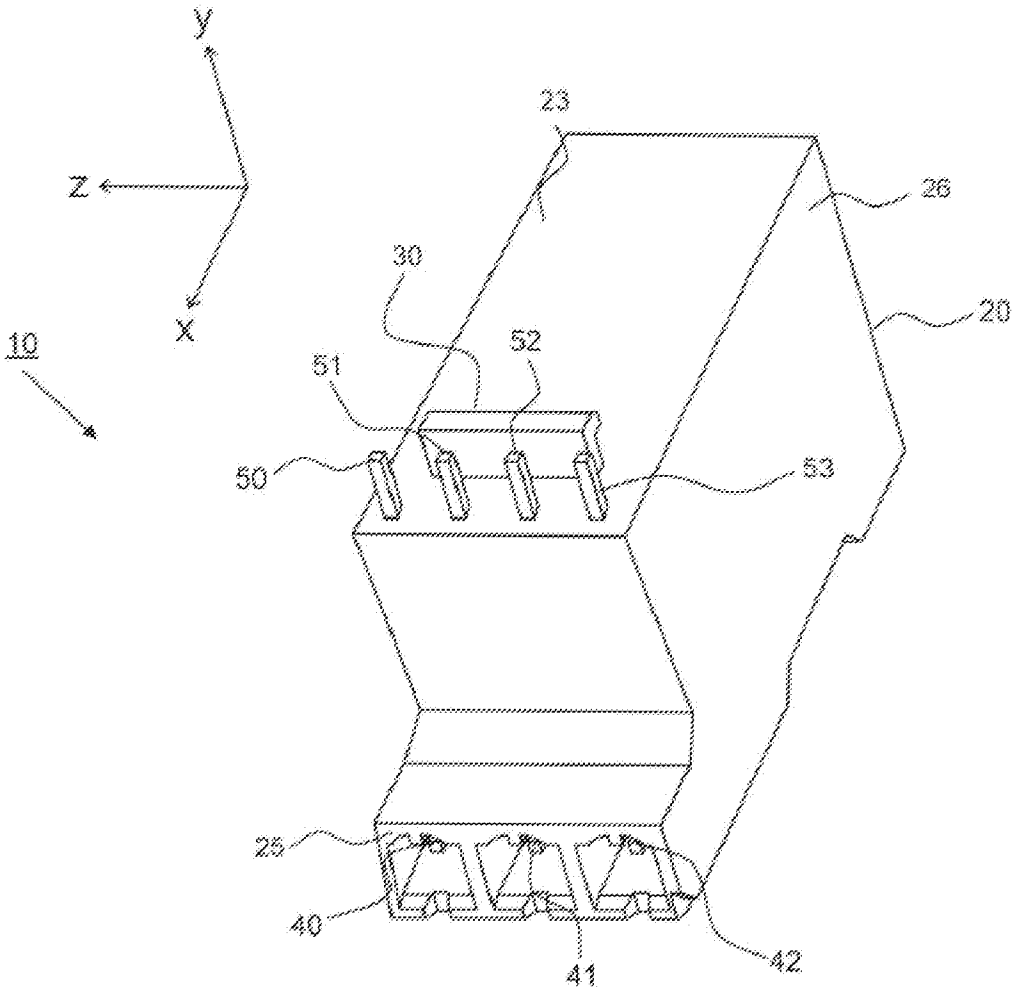
FIG. 2 is a perspective view of a switching contactor module according to the invention.

FIG. 2 shows in a closed state the switching contactor module 10 shown in FIG. 3. It shows the terminal face 25 comprising the electrical terminals 40 to 42 that are formed as contact pins and arranged in the housing 20, the electrical terminals 50 to 53 that are passed out of the terminal face 23 at least in part, and a mechanical connecting element 30, which may for example be formed as a latching bracket and may engage in a corresponding clearance in a safety switching module 130 shown by way of example in FIGS. 5*a* and 5*b*.

So as to be able to expand the modular switching contactor arrangement 180 into a safety switching system, a control and evaluation device 135 may be connected to the third terminals 50 and 51 of the respective switching contactor modules 10 and 11, and is formed to monitor and read back the switching states of the break contacts 64 and to switch on and off a power supply source to the fourth terminals 52 and 53 of the respective switching contactor modules 10 and 11 in a controlled manner.

In an advantageous configuration, which is shown in FIGS. 5*a* and 5*b*, the control and evaluation device 135 is arranged in the separate safety switching module 130. The safety switching module 130 is arranged in a housing 120 that has a width that may substantially correspond to the first width B1 and the second width B2.

As is shown in FIGS. 5*a* and 5*b*, the housing 120 has a base face 121 that faces towards the terminal faces 23 of the switching contactor modules 10 and 11 and the third terminal face 96 of the coupling module 70 in the mounted state. This results in a modular switching contactor arrangement 180 having a safety switching functionality and merely having a construction width of preferably 20 mm to 30 mm, preferably a construction width of 22.5 mm.

Figure 5C:
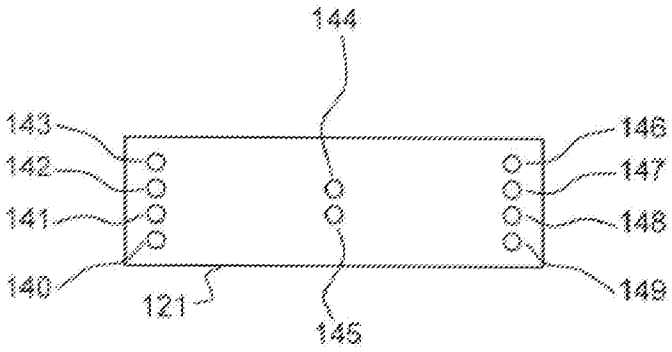
FIG. 5*c* shows the lower face of the safety switching module shown in FIG. 5*a*, with corresponding electrical terminals for connecting the safety switching modules shown in FIG. 5*a* and the coupling module.

As is shown in FIG. 5*c*, a first set of first electrical terminals 140 and 141, a first set of second electrical terminals 142 and 143, a second set of first electrical terminals 148 and 149, and a second set of second electrical terminals 146 and 147 may be arranged on the base face 121 in such a way that, in the assembled state, the electrical terminals of the safety switching module are electrically connected to the third terminals 50 and 51 and the fourth terminals 52 and 53 of the first switching contactor module and to the respective third and fourth terminals of the second switching contactor module 11. If, as shown in FIG. 2, the electrical terminals 50 to 53 of the switching contactor module 10 are formed as contact pins, the terminals 140 to 143 and 146 to 149 of the safety switching module 130 are formed as complementary socket contacts that are preferably arranged in the housing 120.

As is further shown in FIG. 5*c*, the terminals 140 to 143 are located on one end face and the electrical terminals 146 to 149 on the other end face of the base face, so as to be able to be brought into contact with the respective electrical terminals 50 to 53 of the switching contactor module 10 and of the switching contactor module 11. Thus, in the mounted state, the break contact 64 and coil 65 of the switching contactor module 10 and switching contactor module 11 are connected to the control and evaluation device 135 via the electrical terminals 50 to 53 and the electrical terminals 140 to 143 and 146 to 149, the coil 65 being connectable to an energy supply device (not shown) via the control and evaluation device 135. An energy supply device of this type may be part of the safety switching module 130. However, it is also conceivable for an external energy supply device to be connectable to the safety switching module 130 or the control and evaluation device 135.

The base face 121 of the housing 120 of the safety switching module 130 has fixing means 125 for mechanical coupling to the first switching contactor module 10 and/or the second switching contactor module 11 and/or to the coupling module 70. As can be seen in FIGS. 2 and 5*a*, each switching contactor module has a bracket-shaped mechanical connecting element 30 which can engage behind the fixing means 125 of the safety module 130. Preferably, the fixing means 125 is formed as an elongate opening so as to be able to receive the bracket 30 of the switching contactor module 10. Corresponding fixing means may also be provided on the coupling module 70 and on the base face 121.

It should be noted that the phase conductors of a three-phase supply can be connected to the terminals 40 to 42 of the switching contactor module 10. Similarly, the connecting lines of a three-phase load (not shown) can be connected to the terminals 40 to 42 of the second switching contactor module 11 and can be actuated by the modular switching contactor arrangement 180. So as to be able to measure conductor currents and/or voltages that flow through the switching contactor modules 10 and 11, a measurement device 100 may be provided in the coupling module 70, as is shown schematically in FIG. 4. The measurement device is assigned to the first terminals 81 to 83 and second electrical terminals 81' to 83' of the coupling module 70 or to the corresponding electrical connections 87 to 89 to measure currents and/or voltages. The coupling module 70 has for example two terminals 110 and 111 that are passed out of the terminal face 96 and via which the measurement device 100 can be connected to the control and evaluation device 135 of the safety switching module 130. The terminals 110 and 111 are for example formed as contact pins that are passed out of the terminal face 96 and that can be connected to corresponding socket-shaped terminals 144 that may be arranged on the base face 121 of the housing 120. The corresponding terminals 144 and 145 of the safety switching module 130 are shown in FIG. 5*c*.

As is shown by way of example in FIGS. 5*a* and 5*b*, the housing 120 of the safety switching module 130 may have fixing means 150 for fixing the modular switching contactor arrangement 180 to a carrier rail (not shown). The carrier rail may be a top-hat rail. Corresponding fixing means may also be formed on the switching contactor modules 10 and 11 and/or on the coupling module 11. If the modular switching contactor arrangement 180 is fixed to a carrier rail, the elongate extent of the switching contactor arrangement 180 pointing in the y-direction is arranged perpendicular to the longitudinal axis of the carrier rail extending in the z-direction, in such a way that the narrow faces 24 and 25 of the housing 20 and the terminal faces 93 and 94 of the housing 90 define the construction width of the switching contactor arrangement with respect to the carrier rail. In this way, in a switching cabinet, the switching contactor arrangement 180 only takes up an installation space of a width of preferably between 20 mm and 30 mm.

It should further be noted that the base face 21 of the housing, as shown in FIG. 3, may lie in a plane parallel to the x-y plane or else, as shown for example in FIGS. 5*a* and 5*b*, in different planes. The same also applies to the base face 95 of the housing 90.

Figure 6:
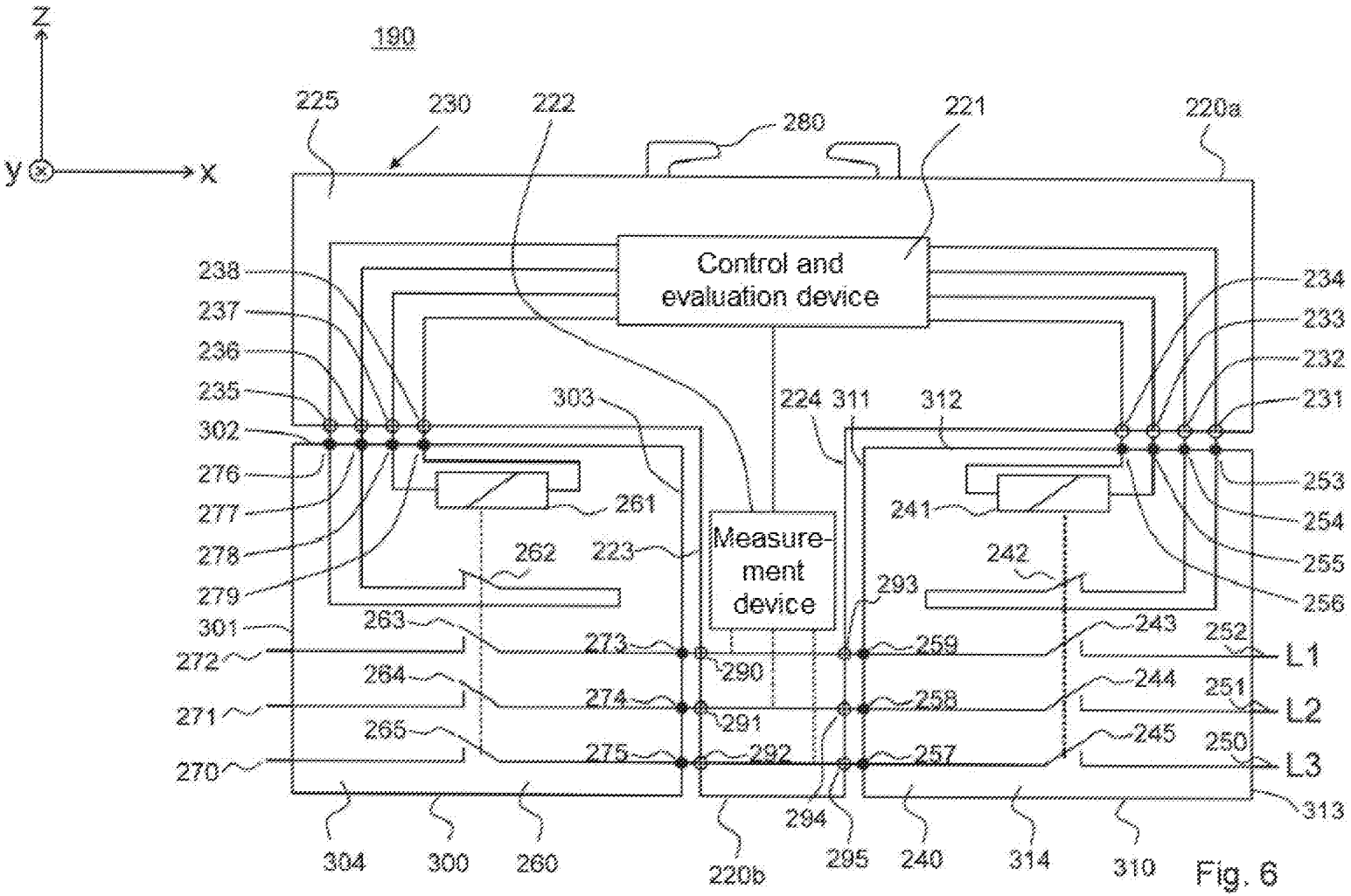
FIG. 6 shows a further example modular switching contactor arrangement, in which a control and evaluation device is arranged in the coupling module.

FIG. 6 schematically shows an alternative example modular switching contactor arrangement 190, in which, unlike in the modular switching arrangement 180, a control and evaluation device 221 may be accommodated in the housing 220*a*, 220*b* of a coupling module 230.

The modular switching contactor arrangement 190 may be formed in particular for use in a safety-oriented application. It has a first switching contactor module 240 and a second switching contactor module 260. The switching contactor module 240 has a switching contactor arranged in a housing 310 to 314 as well as first electrical terminals 257 to 259 and second electrical terminals 250 to 252, a make contact 243 to 245 of the switching contactor being arranged in each case between each first electrical terminal 257 to 259 and each second electrical terminal 250 to 252. In the example shown, three first and three second terminals and three make contacts are implemented in each case. The housing of the switching contactor module 240 has a rectangular base shape 310 having a first predetermined width pointing in the y-direction, two side faces 314 positioned in the xz-plane, which are arranged mutually parallel and at a distance from one another that corresponds to the first predetermined width of the housing, and a first terminal face 311 and a second terminal face 313, which oppose one another in the yz-plane, have the first predetermined width and are arranged perpendicular to the base face 310 at least in portions. The first electrical terminals 257 to 259 are arranged on the first terminal face 311 and the second electrical terminals 250-252 are arranged on the second terminal face 313. The second switching contactor module 260 is preferably constructed substantially identically to the switching contactor module 240.

The switching contactor module 260 has a switching contactor arranged in a housing as well as first electrical terminals 273 to 275 and second electrical terminals 270 to 272, a make contact 263 to 265 of the switching contactor being arranged in each case between each first electrical terminal 273 to 275 and each second electrical terminal 270 to 272. In the example shown, three first and three second terminals and three make contacts are provided in each case. The housing of the switching contactor module 260 has a rectangular base shape 300 having a first predetermined width pointing in the y-direction, two side faces 304 positioned in the xz-plane, which are arranged mutually parallel and at a distance from one another that corresponds to the first predetermined width of the housing, and a first terminal face 303 and a second terminal face 301, which oppose one another in the yz-plane, have the first predetermined width and are arranged perpendicular to the base face 300 at least in portions. The first electrical terminals 273 to 275 are arranged on the first terminal face 303 and the second electrical terminals 270-272 are arranged on the second terminal face 301.

The coupling module 230 is further provided, and has a second predetermined width that is substantially equal to the first predetermined width. The coupling module 230 has an electrical coupling device having first electrical terminals 290 to 292 and second electrical terminals 293 to 295 that are formed and arranged for electrical coupling to the first electrical terminals 257-259 of the first and the first electrical terminals 273 to 275 of the second switching contactor module 260 respectively, the first switching contactor module 240 and the second switching contactor module 260 being electrically and mechanically couplable by means of the coupling module 230 in such a way that, in the mounted state, the make contacts 243-245 of the first switching contactor module 240 and the make contacts 263-265 of the second switching contactor module 260 are electrically connected in series in each case.

It should again be noted that a phase conductor L1 to L3 of a three-phase supply can be connected to each of the terminals 250 to 252 of the switching contactor module 240, while a connecting line of a three-phase load (not shown) can be connected to each of the terminals 270 to 272. The terminals 250 to 252 and 270 to 272 may be formed as contact pins or contact sockets, which may be passed out of the respective housings in part.

The coupling module 230 has a housing 220*a*, 220*b* having a width extending in the y-direction that substantially corresponds to the second predetermined width, the coupling device being arranged in the housing 220*a*, 220*b* at least in part. The housing of the coupling module 230 has two side faces 225, which are arranged in the xz-plane mutually parallel and at a distance from one another that corresponds to the second predetermined width of the housing 220*a*, 220*b*, and a first terminal face 223 and a second terminal face 224, which are positioned in the yz-plane, oppose one another, each have the second predetermined width and are arranged perpendicular to the two side faces 225. The first electrical terminals 290-292 are arranged on the first terminal face 223 and the second electrical terminals 293-295 are arranged on the second terminal face 224. The second switching contactor arrangement 190 thus also has a construction width that is preferably between 20 mm and 30 mm and in particular is 22.5 mm.

In the mounted state, the make contacts 26 to 265, the make contacts 243 to 245, the first electrical terminals 273 to 275 and the second electrical terminals 270 to 272 of the switching contactor module 260, the first electrical terminals 257 to 259 and the second electrical terminals 250 to 252 of the switching contactor module 240 and the first electrical terminals 290 to 292 and the second electrical terminals 293 to 295 of the coupling module 230 are positioned in a shared plane that extends parallel, in other words in the xy-plane, or perpendicular, in other words in the xz-plane, to the base faces 21, 300 and 310. In FIG. 6, the terminals and make contacts are positioned for example in a plane that lies in the xz-plane.

Similarly to the switching contactor modules 10 and 11, the switching contactor modules 240 and 260 may each have a make contact 242 or 262 and a coil 241 or 261. The housings of the switching contactor modules 240 and 260 have a third terminal face 312 or 302 that extends parallel to the base face 310 or 300. Two electrical terminals 276 and 277 that are connected to the make contact 262 and two further electrical terminals 278 and 279 that are connected to the coil 261 are provided on the terminal face 302; similarly, two electrical terminals 253 and 254 that are connected to the make contact 242 and two further electrical terminals 255 and 256 that are connected to the coil 241 are provided on the terminal face 312.

The control and evaluation device 221 may be arranged in the housing of the coupling module 230. The housing of the coupling module 230 may have a T-shaped cross section with respect to the x-z plane, it being possible for the control and evaluation device 221 to be arranged in an elongate housing portion 220*a* extending parallel to the x-axis. The housing portion 220*a* has a first and a second terminal face, which oppose the terminal face 312 of the switching contactor module 240 and the terminal face 302 of the switching contactor module 260 in the mounted state. Terminals 235 to 238 are provided on the second terminal face of the housing portion 220*a* flush with the terminals 276 to 279 of the switching contactor module 260, and are electrically connected to the terminals 276 to 279 in the mounted state. The terminals 235 and 236 are connected to the control and evaluation device 221, while under the control of the control and evaluation device 221 the terminals 236 and 237 can be connected to a supply voltage. Terminals 235 to 238 are provided on the second terminal face of the housing portion 220*a* flush with the terminals 276 to 279 of the switching contactor module 260, and are electrically connected to the terminals 276 to 279 in the mounted state. In this way, the break contact 262 is connected to the control and evaluation device 221 via the terminals 276 and 277 and the terminals 235 and 236, while under the control of the control and evaluation device 221 the coil 261 can be connected to a supply voltage via the terminals 278 and 279 and the terminals 236 and 237. As is indicated in FIG. 6, a supply voltage of this type may also be implemented in the control and evaluation device 221. Similarly, terminals 231 to 234 may be provided on the first terminal face of the housing portion 220*a* flush with the terminals 253 to 256 of the switching contactor module 240, and are electrically connected to the terminals 253 to 256 in the mounted state. In this case, the break contact 242 is connected to the control and evaluation device 221 via the terminals 253 and 254 and the terminals 231 and 232, while under the control of the control and evaluation device 221 the coil 241 can be connected to a supply voltage, which may also be implemented in the control and evaluation device 221, via the terminals 255 and 256 and the terminals 233 and 234. In this way, the control and evaluation device 221 can be connected to the break contacts 242 and 262 to monitor the switching states of the switching contactor modules 240 and 260.

As is shown in FIG. 6, the terminals 276 to 279 of the switching contactor module 260 and the terminals 253 to 256 of the switching contactor module 240 are positioned on a straight line that extends parallel to the X-axis. The terminals 235 to 238 and 231 to 234 of the coupling module are positioned flush therewith on a straight line that extends parallel to the X-axis.

A measurement device 222 for measuring currents and/or voltages, which is electrically connected to the control and evaluation device 221, may be implemented in the housing of the coupling module 230.

For mounting on a current rail, corresponding fixing means may be provided on the housing of the coupling module 230. Further, the housings of the switching contactor modules 240 and 260 and of the coupling module 230 may have fixing means, in such a way that the switching contactor modules 240 and 260 can be mechanically connected to the coupling module 230.

It should be noted that the construction width of the housing of the switching contactor modules 240 and 260 and the construction width of the housing of the coupling module 230 have substantially the same width, which may preferably be between 20 mm and 30 mm and may in particular be 22.5 mm.

It should further be noted that the base faces of the housings of the switching contactor modules 240 and 260 are positioned, as shown in FIG. 6, in a plane that lies parallel to the xy-plane, or else may be positioned in different planes. The same also applies to the base face of the housing of the coupling module 230.

LIST OF REFERENCE NUMERALS

10 Switching contactor module
11 Switching contactor module
20 Housing of the switching contactor module 10 and 11
21 Base face of the switching contactor module housing 20
22, 26 Side faces of the housing 20
23 Third terminal face of the housing 20
24 First terminal face of the housing 20
25 Second terminal face of the housing 20
30 Mechanical connecting element
40-42 Second electrical terminals of the switching contactor module 10
43-45 First electrical terminals of the switching contactor module 10
50, 51 Third electrical terminals of the switching contactor module 20
52, 53 Fourth electrical terminals of the switching contactor module 20
60 Switching contactor
61-63 Make contacts of the switching contactor module 10
64 Break contact of the switching contactor module 10
65 Coil
70 Coupling module
80 Coupling device
81-83 First electrical terminals of the coupling module 70
81'-83' Second electrical terminals of the coupling module 70
87-89 Electrical connections
90 Housing of the coupling module 70
91, 92 Side faces of the housing 90
93 First terminal face of the coupling module 70
94 Second terminal face of the coupling module 70
95 Base face of the housing 90

96 Third terminal face
100 Measurement device of the coupling module 70
120 Housing of the switching contactor module
121 Base face of the switching contactor module 130
125 Fixing means of the housing 120
130 Safety switching module comprising a control and evaluation device 135
135 Control and evaluation device
140, 141 First set of first electrical terminals
142, 143 First set of second electrical terminals
146, 147 Second set of second electrical terminals
148, 149 Second set of first electrical terminals
150 Fixing means of the housing 120 for mounting on a carrier rail
160, 161 Mechanical connecting elements of the coupling module 70
162 Mechanical connecting element of the switching contactor module 11
163 Mechanical connecting element of the switching contactor module 10
180 Modular switching contactor arrangement
190 Modular switching contactor arrangement
220*a*, 220*b* Housing of the coupling module 230
221 Control and evaluation device of the coupling module 230
222 Measurement device of the coupling module 230
223 First terminal face of the coupling module 230
224 Second terminal face of the coupling module 230
225 A side face of the coupling module 230
230 Coupling module
231, 232 Third electrical terminals of the coupling module 230
233, 234 Fourth electrical terminals of the coupling module 230
235, 236 Third electrical terminals of the coupling module 230
237, 238 Fourth electrical terminals of the coupling module 230
240 Switching contactor module
241 Coil
242 Break contact of the switching contactor module 240
243-245 Make contacts of the switching contactor module 240
250-252 Second electrical terminals of the switching contactor module 240
253, 254 Third electrical terminals of the switching contactor module 240
255, 256 Fourth electrical terminals of the switching contactor module 240
257-259 First electrical terminals of the switching contactor module 240
260 Switching contactor module
261 Coil
262 Break contact of the switching contactor module 260
263-265 Make contacts of the switching contactor module 260
276, 277 Third electrical terminals of the switching contactor module 260
270-272 Second electrical terminals of the switching contactor module 260
273-275 First electrical terminals of the switching contactor module 260
278, 279 Third electrical terminals of the switching contactor module 260
290-292 First electrical terminals of the coupling module 230
293-295 Second electrical terminals of the coupling module 230
300 Base face of the housing of the switching contactor module 260
300 Base face of the housing of the switching contactor module 260
301 Second terminal face of the housing of the switching contactor module 260
302 Third terminal face of the switching contactor module 260
303 First terminal face of the housing of the switching contactor module 260
304 A side face of the housing of the switching contactor module 260
310 Base face of the housing of the switching contactor module 240
311 First terminal face of the housing of the switching contactor module 240
312 Third terminal face of the switching contactor module 240
313 Second terminal face of the housing of the switching contactor module 240
314 A side face of the housing of the switching contactor module 240

The invention claimed is:

1. A modular switching contactor arrangement for use in a safety-oriented application, comprising:

a first and a second switching contactor module, which each have:

a switching contactor arranged in a housing and first electrical terminals and second electrical terminals, one make contact of the switching contactor being arranged in each case between each first electrical terminal and each second electrical terminal, the housing having a rectangular base face of a first predetermined width, two side faces, which are arranged mutually parallel and at a distance from one another that corresponds to the first predetermined width of the housing, and a first terminal face and a second terminal face, which oppose one another, have a first predetermined width and are each arranged perpendicular to the base face at least in portions, the first electrical terminals being arranged on the first terminal face and the second electrical terminals being arranged on the second terminal face, a coupling module of a second predetermined width substantially equal to the first predetermined width, the coupling module having an electrical coupling device comprising first electrical terminals and second electrical terminals that are formed and arranged for electrical coupling to the first electrical terminals of the first and second switching contactor module respectively, the first switching contactor module and the second switching contactor module being electrically and mechanically couplable by means of the coupling module in such a way that, in the mounted state, the make contacts of the first switching contactor module and the make contacts of the second switching contactor module are electrically connected in series in each case and the construction width of the switching contactor arrangement is substantially equal to the first and second predetermined width respectively.

2. The modular switching contactor arrangement according to claim 1, wherein:

the coupling module has a housing of a width that substantially corresponds to the second predetermined width, the coupling device being arranged at least in part in the housing, the housing of the coupling module having two side faces, which are arranged mutually parallel and at a distance from one another that defines the second predetermined width of the housing, and a first terminal face and a second terminal face, which oppose one another, each have the second predetermined width and are arranged perpendicular to the two side faces, the first electrical terminals being arranged on the first terminal face and the second electrical terminals being arranged on the second terminal face.

3. The modular switching contactor arrangement according to claim 1, wherein:

the first and second predetermined widths are each between 20 mm and 30 mm.

4. The modular switching contactor arrangement according to claim 3, wherein:

the first and second predetermined widths are substantially 22.5 mm.

5. The modular switching contactor arrangement according to claim 1, wherein:

the mounted state the first electrical terminals and the second electrical terminals of the first switching contactor module, of the second switching contactor module and of the coupling module are positioned in a shared plane that extends parallel or perpendicular to the base face of the housings of the switching contactor modules.

6. The modular switching contactor arrangement according to claim 1, wherein:

the first switching contactor module and the second switching contactor module have three first electrical terminals each and three second electrical terminals each, the switching contactors of the first and second switching contactor modules each having three make contacts, and in that the coupling module has three first electrical terminals and three second electrical terminals in this case.

7. The modular switching contactor according to claim 1, wherein:

the first and second switching contactor modules each have mechanical connecting elements for mechanical connection to mechanical connecting elements of the coupling module.

8. The modular switching contactor arrangement according claim 1, wherein:

the switching contactors of the first switching contactor module and of the second switching contactor module each have a break contact and a magnet system comprising a coil, and in that the first switching contactor module and the second switching contactor module each have two third electrical terminals, connected to the break contact, for connecting a control and evaluation device, and each have two fourth electrical terminals, connected to the coil, for connecting a supply source, said terminals being arranged on a third terminal face, which opposes the base face of the housing in question.

9. The modular switching contactor arrangement according to claim 8, wherein:

the two third and fourth electrical terminals of the first and second switching contactor modules are in each case arranged along a straight line that extends perpendicular or parallel between the two side faces of the housing in question.

10. The modular switching contactor arrangement according to claim 8, further comprising:

a control and evaluation device that can be connected to the third terminals of the first and second switching contactor modules and is formed to monitor and read back the switching states of the break contacts and to switch on and off a power supply source to the fourth terminals of the first and second switching contactor modules in a controlled manner.

11. The modular switching contactor arrangement according to claim 10, wherein:

the coupling module has a housing of a width that substantially corresponds to the second predetermined width, the coupling device being arranged at least in part in the housing, the housing of the coupling module having two side faces, which are arranged mutually parallel and at a distance from one another that defines the second predetermined width of the housing, and a first terminal face and a second terminal face, which oppose one another, each have the second predetermined width and are arranged perpendicular to the two side faces, the first electrical terminals being arranged on the first terminal face and the second electrical terminals being arranged on the second terminal face, and wherein the control and evaluation device is arranged in the housing of the coupling module, the coupling module having a first set of third and fourth terminals and a second set of third and fourth terminals, which are arranged in such a way that, in the assembled state of the switching contactor arrangement, said terminals are electrically connected to the third and fourth terminals of the first switching contactor module and to the third and fourth terminals of the second switching contactor module respectively.

12. The modular switching contactor arrangement according to claim 11, wherein:

the coupling module has a measurement device that is assigned to the first and second terminals of the coupling module for measuring currents and/or voltages, the measurement device being electrically connected to the control and evaluation device.

13. The modular switching contactor arrangement according to claim 10, further comprising:

a safety switching module, which has a housing of the second predetermined width in which the control and evaluation device is arranged, the housing of the safety switching module having a base face on which a first set of first and second electrical terminals and a second set of first and second electrical terminals are arranged in such a way that, in the assembled state of the switching contactor arrangement, the first and second electrical terminals respectively of the safety switching module are electrically connected to the third and fourth terminals of the first switching contactor module and to the third and fourth terminals of the second switching contactor module respectively, the base face of the safety switching module having fixing means for mechanical coupling to the first switching contactor module and/or the second switching contactor module and/or to the coupling module.

14. The modular switching contactor arrangement according to claim 10, wherein:

the housing of the first and/or second switching contactor module and/or the housing of the coupling module and/or the safety switching module have fixing means for fixing the modular switching contactor arrangement to a carrier rail.

* * * * *